US010837308B2

(12) United States Patent
Bazot et al.

(10) Patent No.: US 10,837,308 B2
(45) Date of Patent: Nov. 17, 2020

(54) DEVICE FOR CONTROLLING VARIABLE-PITCH MEMBERS IN A TURBOMACHINE

(71) Applicant: SAFRAN AIRCRAFT ENGINES, Paris (FR)

(72) Inventors: Olivier Bazot, Melun (FR); Jeremy Philippe Pierre Edynak, Viry-Chatillon (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 41 days.

(21) Appl. No.: 16/302,862

(22) PCT Filed: May 23, 2017

(86) PCT No.: PCT/FR2017/051271
§ 371 (c)(1),
(2) Date: Nov. 19, 2018

(87) PCT Pub. No.: WO2017/203158
PCT Pub. Date: Nov. 30, 2017

(65) Prior Publication Data

US 2019/0218929 A1 Jul. 18, 2019

(30) Foreign Application Priority Data

May 25, 2016 (FR) ..... 16 54687

(51) Int. Cl.
*F01D 17/16* (2006.01)
*F01D 17/10* (2006.01)
(Continued)

(52) U.S. Cl.
CPC ..... *F01D 17/162* (2013.01); *F01D 9/041* (2013.01); *F01D 17/105* (2013.01);
(Continued)

(58) Field of Classification Search
CPC .... F01D 17/105; F01D 17/162; F04D 27/002; F04D 27/009; F04D 27/0207;
(Continued)

(56) References Cited

U.S. PATENT DOCUMENTS 3,314,595 A * 4/1967 Burge ..... F04D 29/563 415/160
3,779,665 A 12/1973 Tatem, Jr. et al.
(Continued)

FOREIGN PATENT DOCUMENTS

EP 1 489 267 A1 12/2004
WO WO 2015/093243 A1 6/2015

OTHER PUBLICATIONS

International Search Report dated Oct. 11, 2017 in PCT/FR2017/051271 filed on May 23, 2017.
(Continued)

*Primary Examiner* — Ninh H. Nguyen
(74) *Attorney, Agent, or Firm* — Oblon, McClelland, Maier & Neustadt, L.L.P.

(57) ABSTRACT

A device for controlling variable-pitch turbomachine members such as stator vanes, wherein the movement of a control mechanism is imparted to a ring that rotates the levers for pivoting the vanes about a stator, and takes place with a possible change in the length of the bottle screw connecting the ring to the control mechanism, thereby allowing the blade pitch angle law to be changed according to the extension of the control device. A greater freedom of adjustment is thus obtained. The device can be useful when a single control mechanism is used for multiple rings arranged side by side, making it possible to have different control laws for the rings.

8 Claims, 2 Drawing Sheets

(51) Int. Cl.

| | |
|---|---|
| ***F04D 29/56*** | (2006.01) |
| ***F01D 9/04*** | (2006.01) |
| ***F01D 17/14*** | (2006.01) |

(52) U.S. Cl.
CPC ..... *F01D 17/141* (2013.01); *F04D 29/563* (2013.01); *F05D 2220/30* (2013.01); *F05D 2240/12* (2013.01); *F05D 2250/90* (2013.01); *F05D 2260/76* (2013.01); *F05D 2270/304* (2013.01); *F05D 2270/62* (2013.01)

(58) Field of Classification Search
CPC ..... F04D 27/0246; F04D 29/563; F05D 2250/90; F05D 2260/76
See application file for complete search history.

(56) References Cited

U.S. PATENT DOCUMENTS

| | | | | |
|---|---|---|---|---|
| 6,769,868 | B2 * | 8/2004 | Harrold | F01D 17/162 415/150 |
| 7,273,346 | B2 * | 9/2007 | Bouru | F01D 17/162 415/162 |
| 7,322,790 | B2 * | 1/2008 | Bouru | F01D 17/162 415/162 |
| 7,850,419 | B2 * | 12/2010 | Vrljes | F02C 6/08 415/145 |
| 2005/0129510 | A1 | 6/2005 | Raine et al. | |
| 2013/0039736 | A1 * | 2/2013 | Waugh | F01D 17/162 415/1 |
| 2016/0290361 | A1 | 10/2016 | Ikeguchi et al. | |

OTHER PUBLICATIONS

Preliminary French Search Report dated Jan. 18, 2017 in French Application 16 54687 filed on May 25, 2016.

* cited by examiner

DEVICE FOR CONTROLLING VARIABLE-PITCH MEMBERS IN A TURBOMACHINE

The subject of the invention is a control device for controlling variable-pitch elements in a turbomachine.

These elements can for example be variable bypass valves (VBV) of compressors, or vane stator stages (SVS), given that the invention can be applied to any turbomachine device comprising variable-pitch (position adjustable) elements, controlled by a common actuator mechanism and respective mechanical transmissions connecting the actuator mechanism to said elements and comprising stretching screws. Another aspect of the invention is a turbomachine equipped with this device.

Let us discuss a particularly contemplated application to illustrate the field of the invention.

The stator vanes of turbomachines play an essential role in lifting the gas flow between two stages of moving vanes of the rotor. These vanes, often called fixed vanes, can however have a variable pitch, that is they can pivot about their support axis to modify their orientation and the lift they impose to the flow depending on the conditions encountered. The usual pitch adjustment devices comprise an actuator mechanism able to rotate about the turbomachine axis a ring surrounding the stator and connected to pivoting axes of the vanes, projecting from the stator, by hinged-type connecting rods which thus transform the rotation of the ring about the machine axis into a rotation of the stator vanes about their radial axis. A single actuator mechanism often controls several vane stages at a time, by rotating as much rings as them. An example is given in document EP 1 489 267 A1, where an adjustable compensation means is additionally added, which enables different rotations to be controlled for two neighbouring rings. The actuator mechanism common to the rings is often a pivoting control shaft, the rotation angle of which is controlled by extending an actuator jack. The control shaft is provided with rotating levers which are connected to the respective rings by hinged-type connecting rods called stretching screws.

A careful examination of the operation of the turbomachine shows that that could be improved in some circumstances, for example at transient states, or some particular conditions of service. In other words, the ideal pitches are not reached. That is particularly clear when a plurality of rings and vane stages is controlled by a single actuator mechanism. Devices such as that of the abovementioned document, which enable the controls imposed to different rings by the same mechanism to be dissociated, are however difficult to implement.

The object of the invention is thus to offer more extended and more flexible control possibilities to devices of variable-pitch elements such as variable-pitch stator vanes or variable bypass valves of a compressor. The device of the invention has also the advantage of not increasing the complexity of usual devices since the transmission of the motion is made in the same way; the mass increase it implies is not much significant; and it will be also easy to modify its adjustment for the duration of the machine, to take account in particular of its degradation, without conducting expensive replacements of parts.

According to the invention, at least one of the stretching screws (and possibly several of the stretching screws, or all the stretching screws) is a variable-length member, controlled by a length adjustment device. Thus, it becomes possible to freely choose, and independently from each other, the pitches of the different elements in spite of a single actuator mechanism.

The member can be a jack, and in particular an electro-jack.

A particular case likely to be important appears when the control law imposes different lengths to the member, for identical positions of the actuator mechanism, along the direction of motion of the actuator mechanism. Another corresponds to a situation where the control law imposes length variations of the member only at some positions of the actuator mechanism, thus to provide a local pitch correction.

According to other possible embodiments, which may be added to the previous ones, the length adjustment device of each member can become active for some particular conditions of the turbomachine, based on, for example, the thrust it produces, or its rotational speed.

Another aspect of the invention is a turbomachine equipped with these devices.

The invention will now be described in more detail by means of the following figures, which develop various aspects, characteristics and advantages thereof in accordance with embodiments given by way of illustrating purposes:

and FIGS. 4, 5, 6 and 7 illustrate the possible control laws for the stretching screw.

Figure 1:
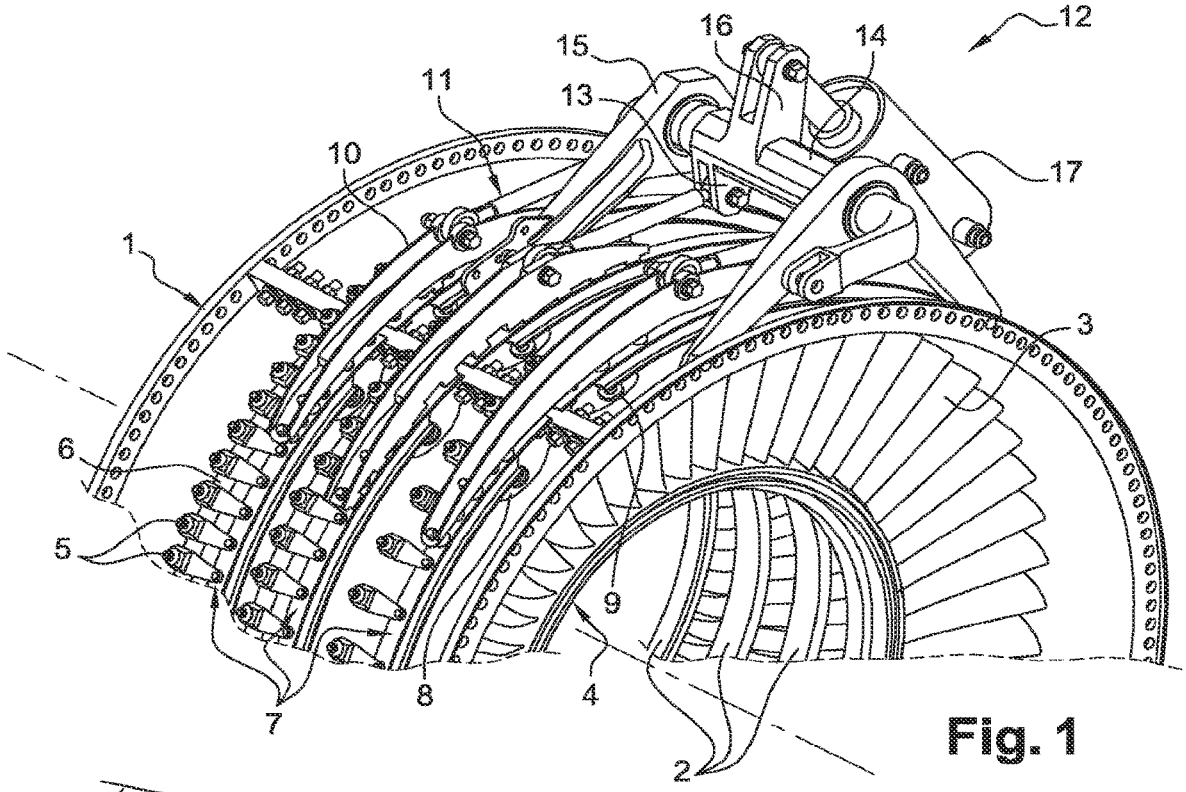
FIG. 1 illustrates a pitch adjustment device for several vane stages in accordance with an application of the invention.
Figure 2:
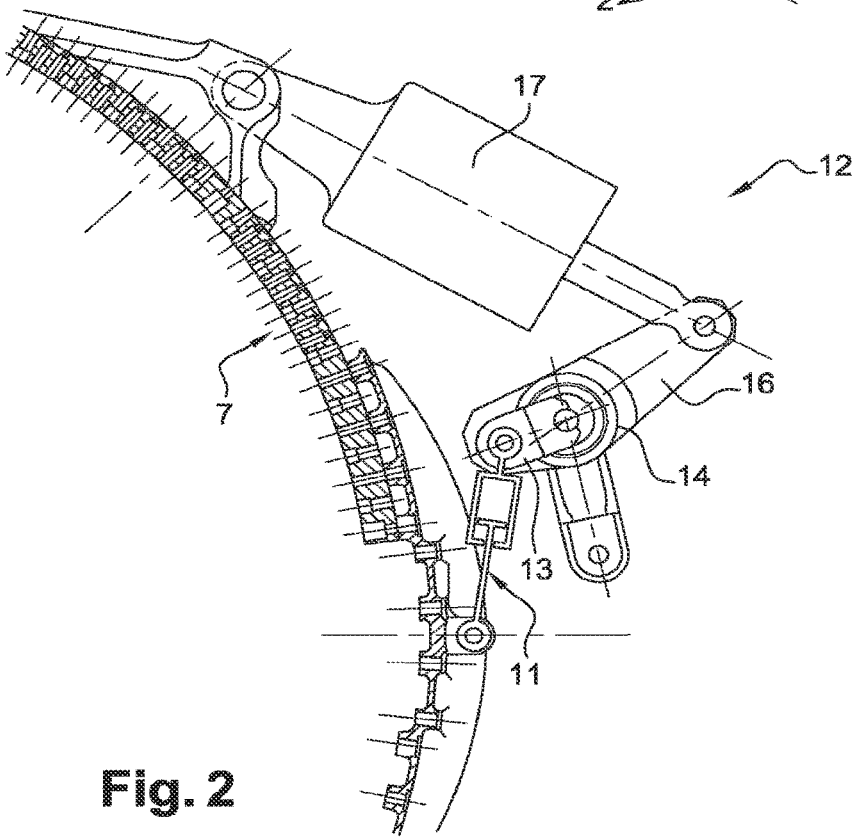
FIG. 2 is a side view of the actuator mechanism, of one of the vane stages and the stretching screw associated therewith.

The comment of FIGS. 1 and 2 is discussed.

A turbomachine, which is only partially represented, at the place where it is modified by the invention, comprises a stator outer case 1 that can be in particular a compressor case and three stages 2 of variable-pitch vanes 3. The stages 2 are aligned along the central axis of the turbomachine and located close to each other. They comprise internal ferrules 4 to which the vanes 3 are hinged by their radially inner ends. The outer radial ends of the vanes 3 are pivots projecting from the case 1, with a square cross-section for example, and engaged in a pierced hole with the same cross-section of a control lever 6. The control levers 6 are hinged to control rings 7 (one per stage 2), which bear on guide tracks 8 of the case 1 by guide shoes 9. The control rings 7 each include an arch-shaped bridge 10 at its outer periphery, in the centre of which an end of a stretching screw 11 is hinged, the other end of which is hinged to an actuator mechanism 12, and more precisely to a lever 13 of a control shaft 14 pivoting on a yoke 15 erected on the case 1, and provided with a further lever 16 which swings a control jack 17 disposed between this lever 16 and the case 1. The extension or retraction of the control jack 17 pivots the control shaft 14 about an axis parallel to that of the turbomachine, pushes back the stretching screws 11 in a direction tangent to the case 1 and imposes a rotation to the control rings 7, while swinging the control levers 6, which pivots the vanes 3 about their axis 5. Other control mechanisms exist, including that which is described in the aforementioned document. The invention can be applied to all the control systems for controlling the pitch of vanes using stretching screws. The parts of the device that it modifies will now be more specially described.

Figure 3:
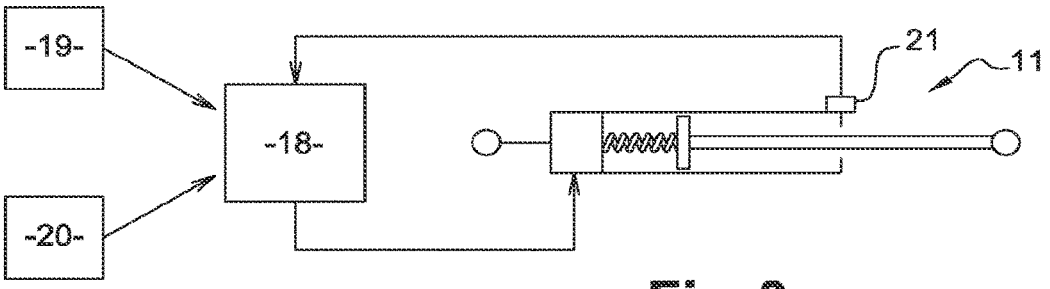
FIG. 3 illustrates the control system for controlling the stretching screw.

The stretching screw 11 is no longer an inert connecting rod, in accordance with the usual designs of the invention, but a variable-length linear jack, which can thus impose rotations to a control ring 7 it controls, independently of the action of the common control jack 17. Each of the jacks 11 is an electro-jack controlled by a length adjustment device 18 (FIG. 3), which can receive in particular information from a first system 19 for generally controlling the pitch, indicating the motions imposed to the main control jack 17, of a second general control system 20 sensitive to other parameters of the turbomachine, as the thrust it generates or its rotational speed, and a sensor 21 associated with the stretching screw 11 itself and measuring the motion imposed thereto; it can be a linear variable differential transformer (LVDT), the accuracy of which is $10^{-2}$ mm. Such a sensor, which is also used for the control jack 17, makes it possible to check the compliance between the motions imposed to the stretching screw 11 and those which are actually applied. The use of electro-jacks for the stretching screws 11, instead of hydraulic jacks as the control jack 17 is, allows a simpler mounting by avoiding the use of fluid pipings likely to leak, and a low weight increase. The main control devices 19 and 20 are more precisely in charge of instructing the length adjustment device 18 to implement movement laws for the stretching screw 11 which have been programmed thereto, or possibly to modify them in some circumstances.

Figure 4:
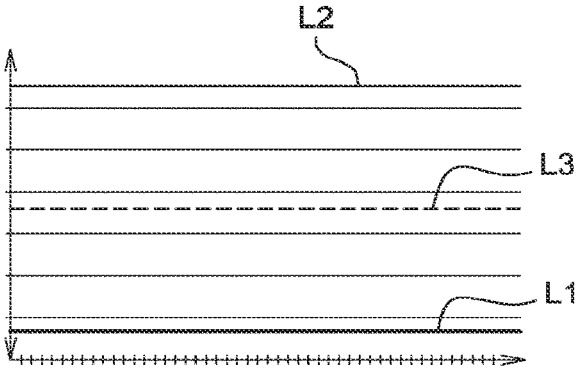
Figure 5:
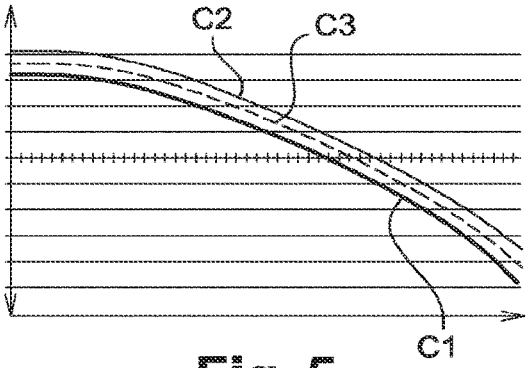

A possible control law is represented in FIGS. 4 and 5, the first one being which is a diagram indicating the length of the stretching screw 11 as a function of the stroke of the control jack 17. It is found that this law consists in constantly shortening the stretching screw 11, represented by the line segment L1, throughout the stroke of an opening or extending motion of the control jack 17, and a constant extension, expressed by the line segment L2, for a closing motion of the control jack 17, with respect to the nominal length, expressed by the line segment L3, of the stretching screw 11. More generally, the stretching screw 11 could be controlled at different lengths along the direction of rotation of the ring 7 about the stator 1.

The pitch angle of the vanes 3 with respect to the position of the control jack 17 could thereby be expressed in FIG. 5 by the curves C1, C2 and C3 respectively obtained for opening the control jack 17, closing it, and by supposing that the nominal length value for the stretching screw 11 is held. It can be seen that these three curves C1, C2 and C3 are nearly parallel to each other, but with a nearly constant pitch difference for each length of the control jack 17, depending on whether it is extended or retracted.

Figure 6:
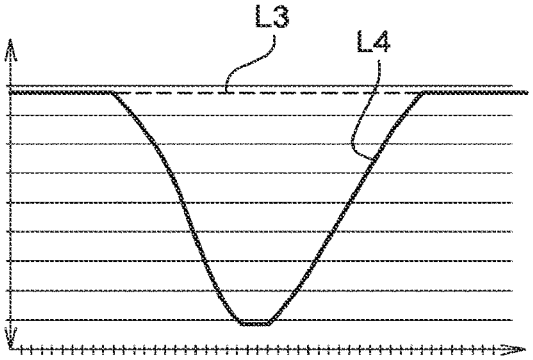
Figure 7:
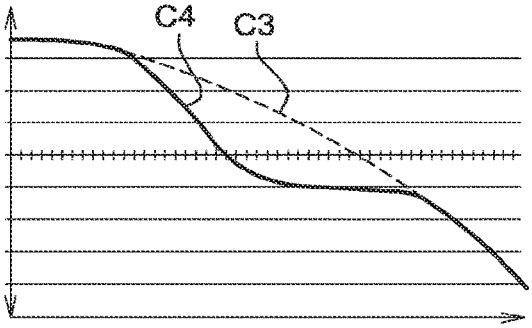

Another possible control law is expressed by means of FIGS. 6 and 7 if the length of the stretching screw 11 is shortened below the nominal value, still expressed by the line segment L3 for a part of the stroke of the control jack 17, which is illustrated by the curve L4: a deviation of the nominal pitch angle is recorded at the corresponding positions, based on curve C4.

These two simple examples show that it is easy to impose very various pitch laws depending on the extension of the control jack 17, wherein these laws can in particular be different for each of the control rings 7 of the stages 2, which is an essential advantage of the invention. Likewise, the laws could be amended to be replaced by other ones when the circumstances require it, for example according to the indications of the second main control system 20, if for example the turbomachine is in an intensive acceleration phase, with a very strong thrust, to avoid at that time the pitches which would impose an excessive strain on the vanes 2. The above considerations remain valid when the invention is applied to variable bypass valves pitch; the control law can thereby be designed to allow in particular selective openings or closings of a part of the valves, or time offsets in opening or closing.

The invention claimed is:

1. A control device for controlling variable-pitch elements in a turbomachine, comprising a common actuator mechanism and mechanical transmissions connecting the actuator mechanism to the variable-pitch elements, the mechanical transmissions each comprising a stretching screw, where at least one of the stretching screws is a variable-length member, controlled by a length adjustment device, wherein the length adjustment device contains a control law for controlling the length of said member based on positions of the actuator mechanism, and wherein the control law imposes length variations of said member only at some positions of the actuator mechanism.

2. The control device according to claim 1, wherein the variable-pitch elements are stages of stator vanes.

3. The control device according to claim 1, wherein the variable-length member is an electro-jack.

4. The control device according to claim 1, wherein the length adjustment device is associated with a control system which imposes length variations of said member based on operational parameters of the turbomachine.

5. The control device according to claim 4, wherein the operational parameters comprise either a thrust, or a rotational speed of the turbomachine.

6. The control device according to claim 1, comprising a plurality of said variable-length members, wherein the length adjustment device imposes different lengths to jacks.

7. A control device for controlling variable-pitch elements in a turbomachine, comprising a common actuator mechanism and mechanical transmissions connecting the actuator mechanism to the variable-pitch elements, the mechanical transmissions each comprising a stretching screw, where at least one of the stretching screws is a variable-length member, controlled by a length adjustment device, wherein the length adjustment device contains a control law for controlling the length of said member based on positions of the actuator mechanism, wherein the control law imposes different lengths of said member, for identical positions of the actuator mechanism, along a direction of motion of the actuator mechanism, and wherein said different lengths have a constant difference value.

8. The control device according to claim 7, wherein said different lengths are both uniform over an entire stroke of the actuator mechanism.

* * * * *